US006467622B1

(12) United States Patent
Hull

(10) Patent No.: US 6,467,622 B1
(45) Date of Patent: Oct. 22, 2002

(54) ADJUSTABLE ORGANIZER

(75) Inventor: Kenneth W. Hull, Wooster, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 09/689,479

(22) Filed: Oct. 12, 2000

(51) Int. Cl.[7] ..... B65D 1/34
(52) U.S. Cl. ..... 206/553; 206/561
(58) Field of Search ..... 206/553, 561, 206/562, 597, 564, 371; 220/8; 312/348.3, 205

(56) References Cited

U.S. PATENT DOCUMENTS

| | | | | | |
|---|---|---|---|---|---|
| 876,235 | A | * | 1/1908 | Quackenboss | 220/8 |
| 958,857 | A | | 5/1910 | Dennis | |
| 2,214,042 | A | | 9/1940 | Burdick | |
| 2,218,300 | A | | 10/1940 | Schuster | |
| 2,369,728 | A | * | 2/1945 | Farkas | 220/8 |
| 2,475,961 | A | * | 7/1949 | Hilbert | 190/47 |
| 2,889,924 | A | | 6/1959 | Paulucci | |
| 3,135,383 | A | | 6/1964 | Bloch | |
| 3,463,343 | A | * | 8/1969 | Asenbauer | 220/8 |
| 3,703,326 | A | | 11/1972 | Riviers | |
| 4,061,395 | A | | 12/1977 | Boole | |
| 4,288,011 | A | | 9/1981 | Grossman | |
| 4,305,629 | A | | 12/1981 | Friis | |
| 4,412,709 | A | | 11/1983 | Ishii | |
| 4,478,337 | A | | 10/1984 | Flum | |
| 4,909,406 | A | | 3/1990 | Wu | |
| 4,982,857 | A | | 1/1991 | Sher | |
| 4,993,786 | A | | 2/1991 | De Giulio | |
| 5,016,772 | A | | 5/1991 | Wilk | |
| 5,031,769 | A | | 7/1991 | Shea et al. | |
| 5,056,458 | A | | 10/1991 | Askeland | |
| 5,102,208 | A | | 4/1992 | Joynes et al. | |
| 5,139,186 | A | | 8/1992 | Loew et al. | |
| D330,219 | S | | 10/1992 | Carlson et al. | |
| 5,160,026 | A | | 11/1992 | Marsh | |
| 5,242,223 | A | | 9/1993 | Koves | |
| 5,292,571 | A | | 3/1994 | Quinn | |
| 5,302,015 | A | | 4/1994 | Du Vall | |
| D353,905 | S | | 12/1994 | Lin | |
| 5,385,230 | A | | 1/1995 | Nygard et al. | |
| 5,411,165 | A | | 5/1995 | Ellis | |
| 5,421,646 | A | | 6/1995 | McNamara et al. | |
| 5,738,425 | A | | 4/1998 | Rosenberg et al. | |
| D421,554 | S | * | 3/2000 | Govrik et al. | D7/637 |

OTHER PUBLICATIONS

Photocopy of promotional material for "Expand–A–Drawer", by Dynatec International Inc., undated, 1 sheet.
Photocopy of promotional material for "The More Drawer Organizer", by DV International, bearing a designation 1998, 2 sheets.
Photocopy of page from sales catalog for "Expand–A–Drawer Organizer", undated, 1 sheet.

* cited by examiner

*Primary Examiner*—Shian Luong
(74) *Attorney, Agent, or Firm*—Marshall, Gerstein & Borun

(57) ABSTRACT

An organizer for separating and holding a plurality of items is disclosed. The organizer includes a main compartment, at least one side compartment, and an adjustable retaining system. The adjustable retaining system is configured to selectively couple the main compartment to each side compartment and hold each side compartment in one of a plurality of positions relating to the main compartment.

17 Claims, 7 Drawing Sheets

ADJUSTABLE ORGANIZER

FIELD OF THE INVENTION

The present invention relates to an apparatus used to sort, segregate, and organize various items within an enclosed space. In particular, the present invention relates to an organizer having an adjustable width.

BACKGROUND OF THE INVENTION

Organizers come in a variety of sizes and configurations and are frequently used to store items in a separate enclosure (e.g., a drawer). Examples of items which can be organized include cutlery, mixing utensils, eating utensils, stationary supplies, etc. Typically, drawer organizers include a plurality of compartments sized and arranged to receive a variety of items for storage and easy accessibility.

It is known to provide one or more boxes within a drawer. However, such an arrangement does not utilize the entire space within the drawer and the individual boxes may slide around and become disorganized.

Drawer organizers having a plurality of compartments are also known. However, such organizers typically do not adequately utilize the space within the drawer and may slide around when the drawer is opened or closed, requiring constant readjustment and repositioning.

In an attempt to overcome the shortcomings of such organizers, the use of "adjustable" or "custom" organizers may be employed. However, such products require cutting of material and are difficult to install. Prior organizers of this type are typically characterized by their lack of adjustability, inconvenience, inability to utilize the entire enclosure, or lack of a locking mechanism. As a result, such organizers are generally not well-suited for situations where reorientation and arrangement of the organizer is different or inconvenient. For example, after opening and closing a drawer several times, the organizer must be repositioned or reoriented. When the drawer is used often (e.g., for flatware), there may be a lot of movement that causes the organizer to lose its set positioning. Such "movement" may include picking the organizer up (e.g., to access areas of the drawer behind or otherwise adjacent to the organizer), or action created by the movement of a drawer to access the items stored in the organizer.

Second, certain known organizers can be adjusted but the methods for doing so involve inefficient steps. Third, even if adjustable, prior organizers are frequently not used as intended because of their inconvenience, and therefore the benefit of "adjustability" is not realized by the user.

Thus, there is a continuing need for an organizer having one or more compartments moveable between an extended position and a retracted position, the organizer being held or "locked" in a desired configuration. It would also be desirable if the product communicates to the user when the organizer is "locked" into the desired position.

Accordingly, it would be advantageous to have an organizer with adjustable width. It would also be advantageous to have an adjustable organizer capable of being secured or "locked" in a desired position. It would further be advantageous to have a "locking" adjustable organizer that signals to the user when it is in the locked position. It would further be advantageous to have an adjustable organizer that requires a minimum amount of assembly.

SUMMARY OF THE INVENTION

The present invention relates to an apparatus for separating and holding a plurality of items. The apparatus includes a main compartment, at least a first side compartment, and an adjustable retaining system. The adjustable retaining system is configured to couple the main compartment to the first side compartment in a plurality of different positions. The first side compartment can be held in a desired position by a compliant retaining system.

The present invention also relates to an apparatus for holding a plurality of items. The apparatus includes a main section having one or more compartments, at least a first side compartment, and a means for reasonably coupling the main section to the first side compartment.

The present invention further relates to an apparatus for separating a plurality of items. The apparatus includes a main section having one or more compartments, a first side compartment, and a means for releasably coupling the main section the first side compartment.

The present invention further relates to various features and combinations of features shown and described in the disclosed embodiments.

DETAILED DESCRIPTION OF EXEMPLARY EMBODIMENTS

Figure 1:
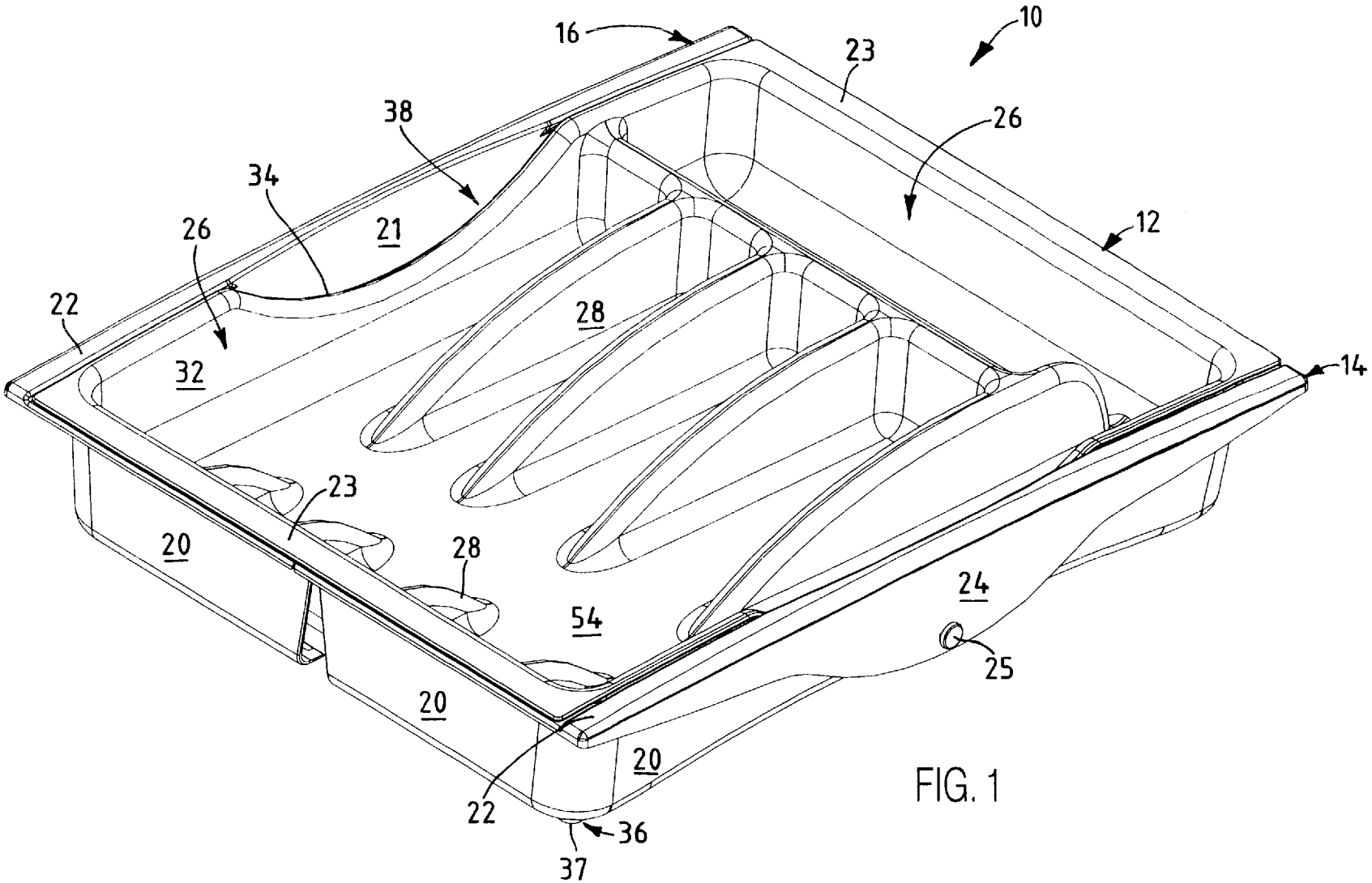
FIGS. 1 and 2 are top perspective views of a drawer organizer according to an exemplary embodiment of the present invention.
Figure 2:
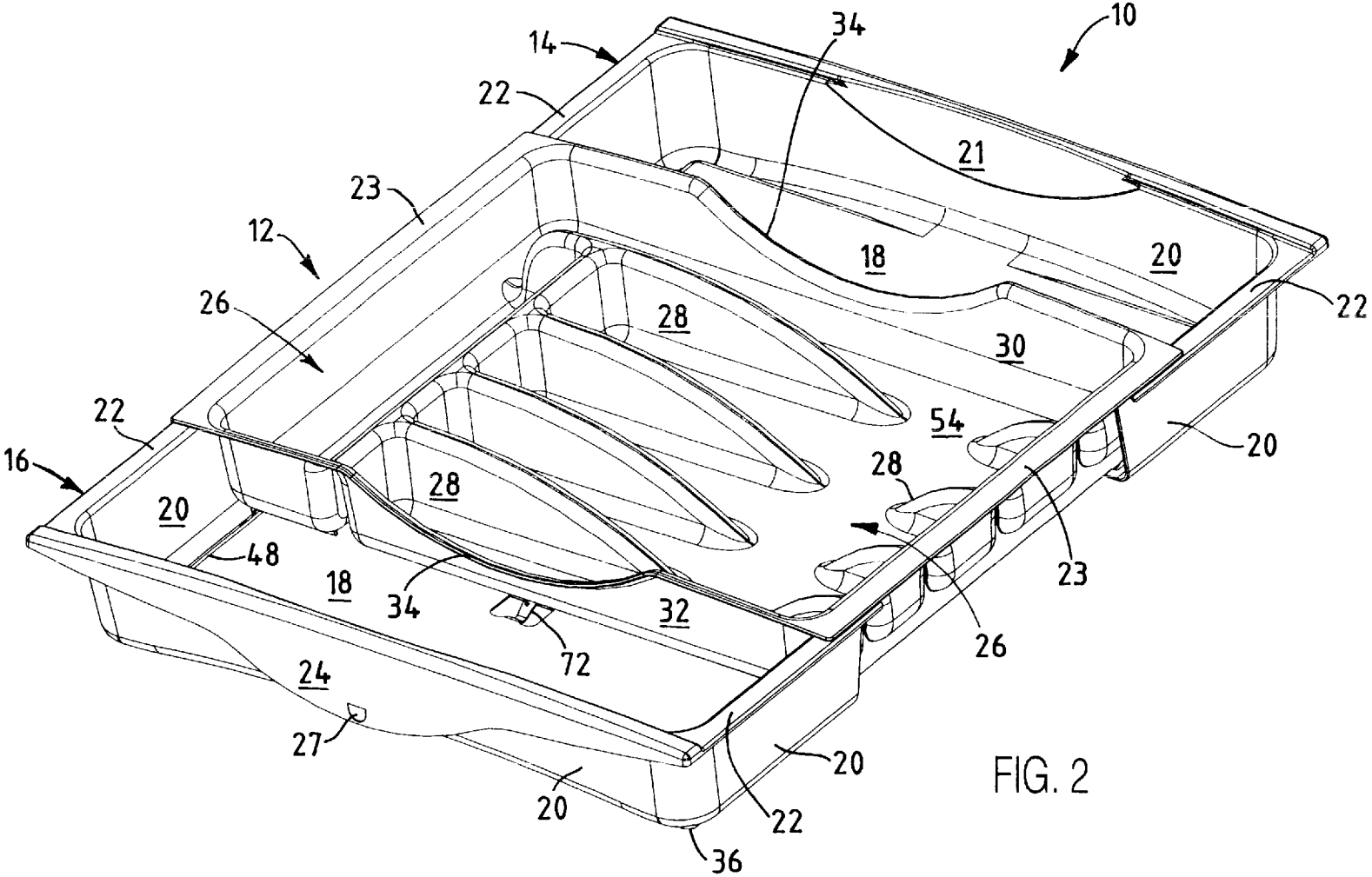

FIGS. 1 and 2 show an organizer 10 used to sort and segregate various items within an enclosed space. Organizer 10 also is configured to be adjustable to various widths. Organizer 10 includes a main compartment 12, and a pair of side compartments 14, 16, that function as one piece once assembled. Once set at the desired width, side compartments 14, 16 will remain at that setting until readjusted by the user. According to an alternative embodiment, drawer organize 10 has any number of side compartments (e.g., 1, 2 (as shown), 3, 4, etc.) coupled to main compartment 12. According to a preferred embodiment, organizer 10 is molded from polypropylene, but it may be made from any of a variety of materials.

FIG. 1 shows side compartments 14, 16 in the retracted position and FIG. 2 shows side compartments 14, 16 in the extended position. When side compartment 14 and/or 16 is in an at least partially extended position, items may be stored and organized in them. As such, at least partially extended side compartments provide another level of organization for storing items. Side compartments 14, 16 include a bottom 18 and generally vertical walls 20. Walls 20 are spaced apart and configured to slideably receive main compartment 12. Sidewalls 20 includes a hand pad 21 which provides a surface for the user to grip side compartments 14, 16 for adjustment or placement (e.g., to differentiate sidewall 14, 16 from hand pad 21). A lip 22 is provided along the top of walls 20 and is configured to provide a sliding surface for lip 23 of main compartment 12.

Side compartments 14, 16 also include a compliant member configured to deflect when side compartments 14, 16 are extended and forced against the walls of the enclosure or drawer. When the compliant member deflects, a biasing force acts to hold organizer 10 between the walls of the enclosure so that movement of the enclosure does not reposition organizer 10. The biasing force is less than the force necessary to retract side compartments 14, 16 (e.g., the force necessary to move prong 72 relative to teeth 70). According to a preferred embodiment, compliant member is a flange 24 that extends generally downwardly and outwardly from lip 22 and is configured to deflect toward sidewalls 20 when pressed against the wall of the enclosure (e.g., to "pre-stress" the locking engagement of main compartment 12 and side compartments 14, 16). Flange 24 is also configured to provide a convenient place for the user to adjust organizer 10 (e.g., to allow a light sideways push on the side components to move them relative to the main compartment).

According to an alter native embodiment, the compliant member includes a compressible bumper or pad 25 positioned in a recess 27 on side compartments 14, 16. Pad 25 is configured to deflect toward sidewalls 20 to match the contour of the wall of the enclosure and to pre-stress the locking engagement of main compartment 12 and side compartments 14, 16. Alternatively, pad 25 coacts with flange 24 to provide a compliant member.

Main compartment 12 includes one or more areas 26 which are sized and shaped to receive items (e.g., flatware, tools, accessories, etc.). According to a preferred embodiment areas 26 are integrally molded with main compartment 12. As shown in the FIGURES, areas 26 are defined by one or more walls 28 configured to provide storage areas to segregate and organize items. Sidewalls 30, 32 of main compartment 12 include a recess 34 that is intended to allow the user access to the hand pad 21. Hand pads 21 on sidewalls 20 of side compartments 14, 16 are configured to be disposed adjacent to recess 34 when side compartments 14, 16 are in the retracted position.

Feet 36 are provided at the corners of side compartments 14, 16 and are configured to provide a level support surface for organizer 10. According to a preferred embodiment, non-slip pads 37 are attached to feet 36 (e.g., with an adhesive, pressure sensitive adhesive, thermal bonding, etc.), and are configured to inhibit movement of organizer 10 in the enclosure. Pads 37 may be made from any number of materials that provide a non-slip or griping surface (e.g., rubber, etc.). Top opening 38 of main compartment 12 and bottom 18 of side compartments 14, 16 are shaped and sized to provide a nesting function with other organizers 10.

Figure 3:
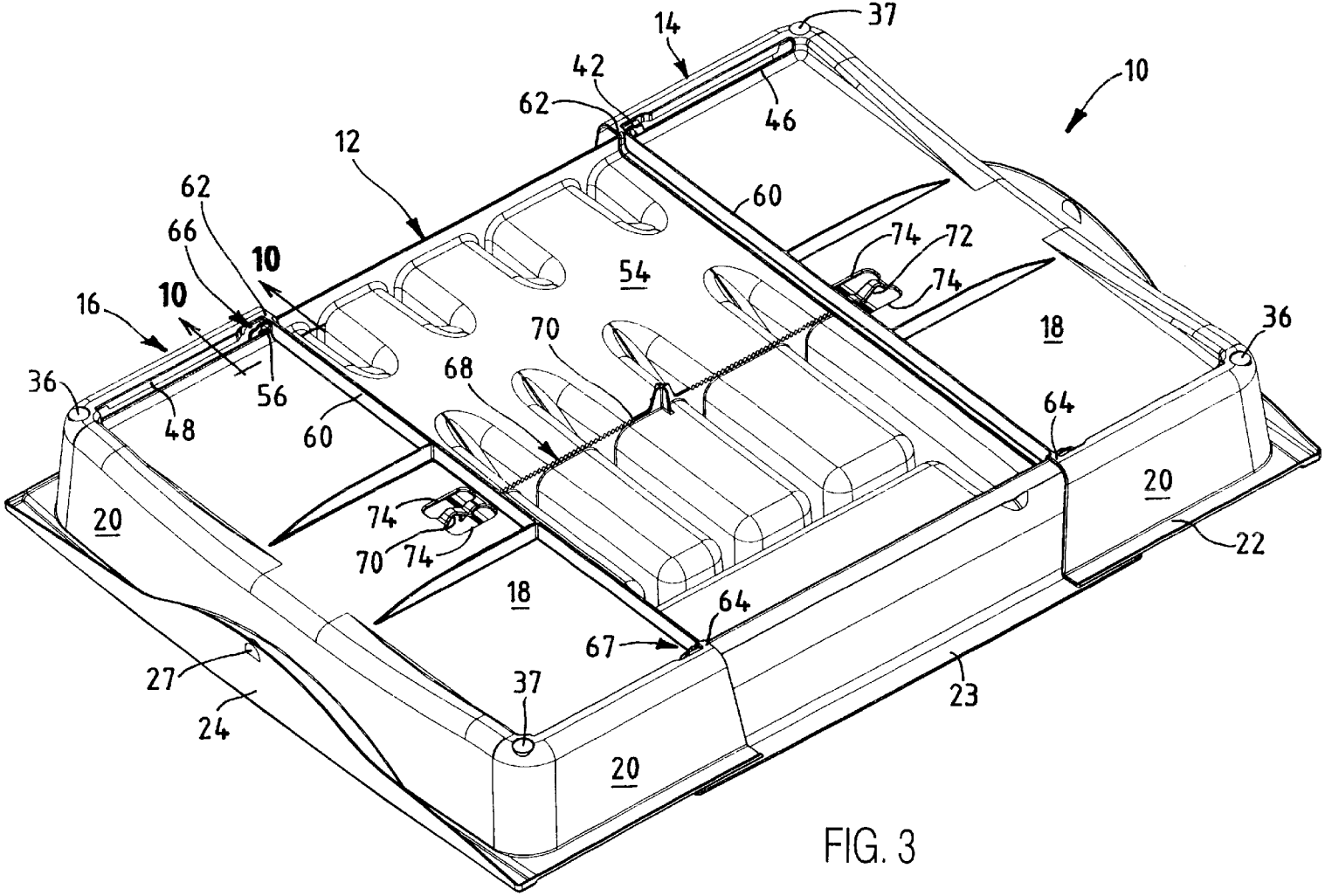
FIG. 3 is a bottom perspective view of the drawer organizer of FIG. 2.
Figure 4:
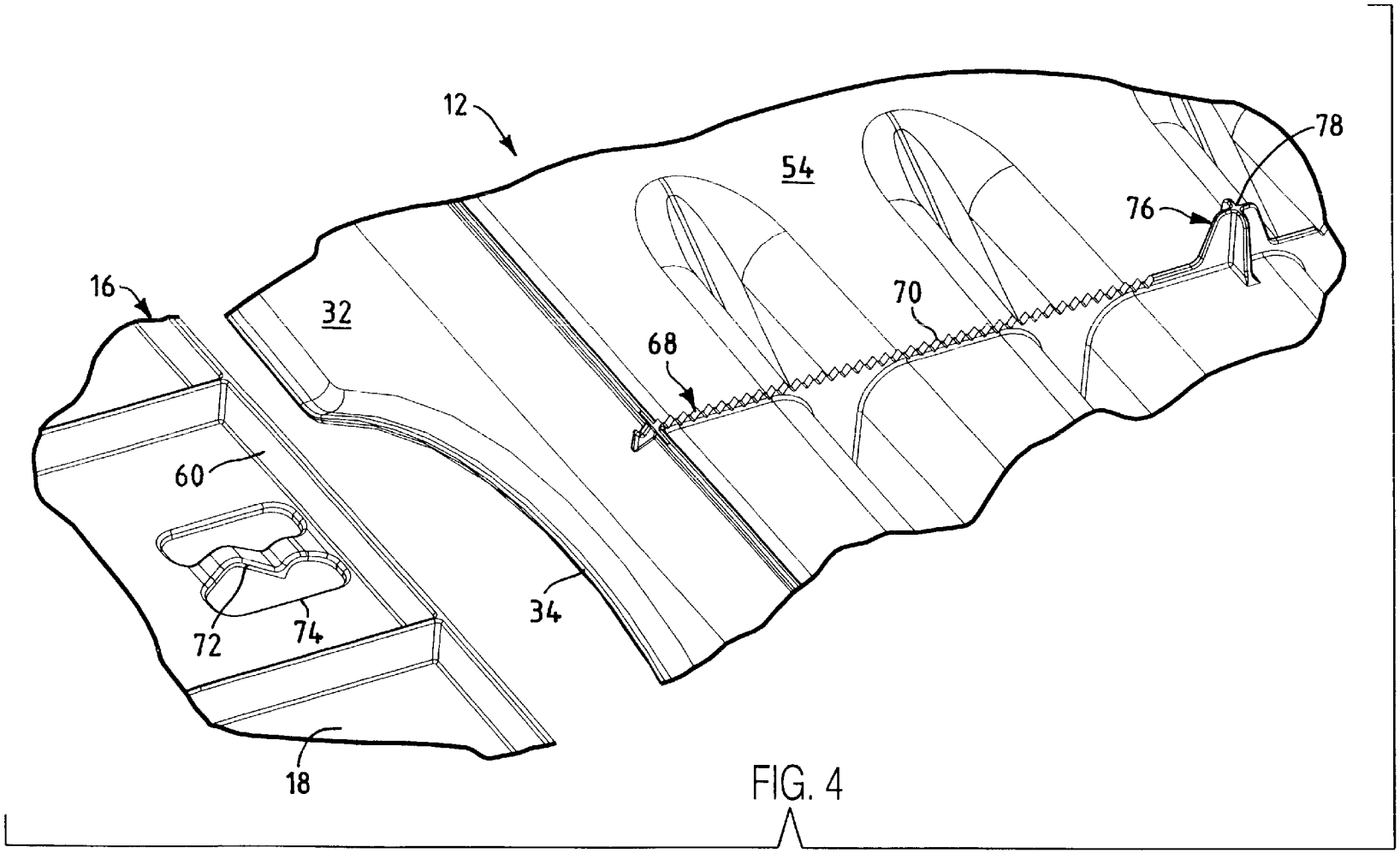
FIG. 4 is an exploded fragmentary elevation view of the drawer organizer of FIG. 3.
Figure 5:
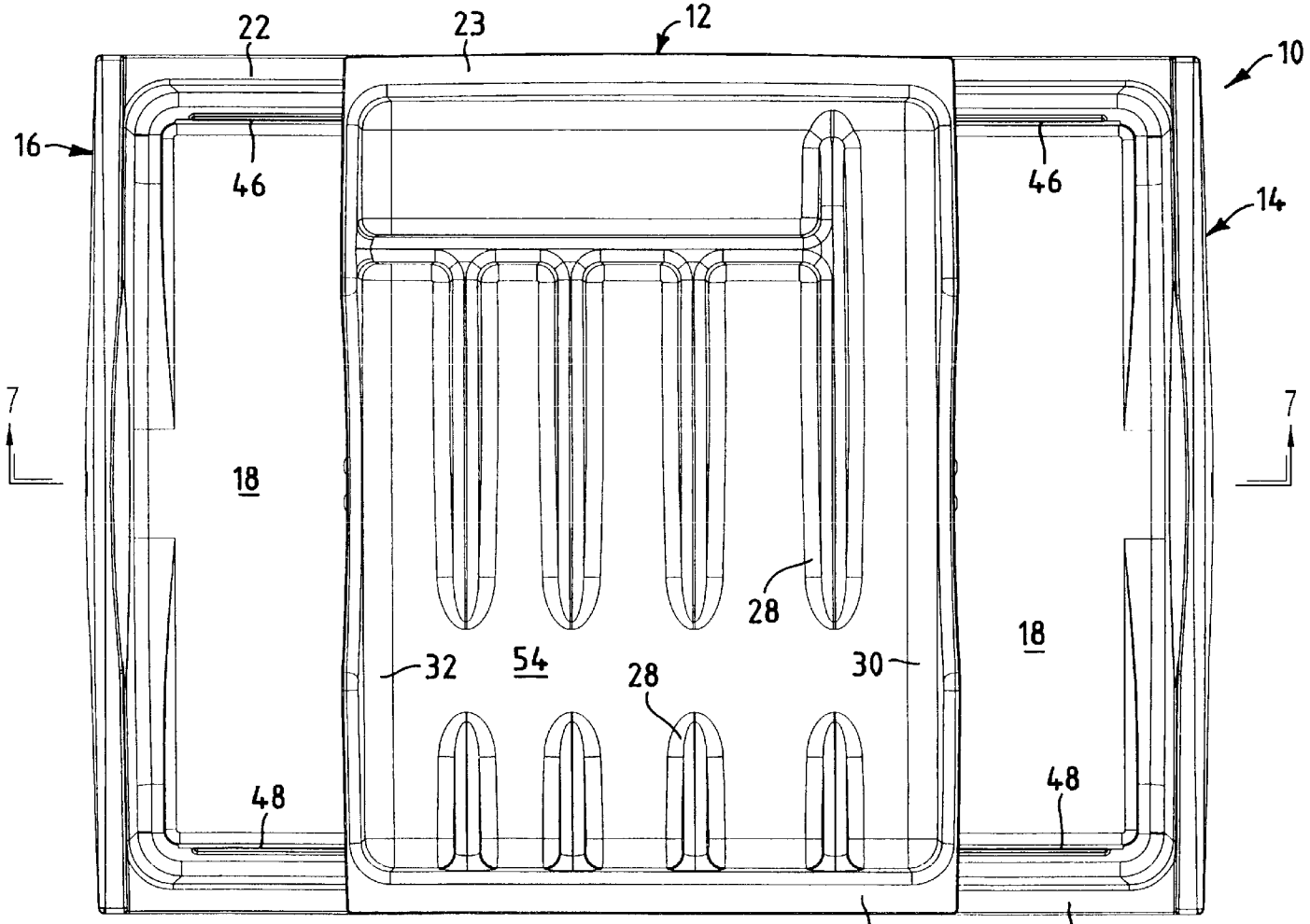
FIG. 5 is top elevation view of the drawer organizer of FIG. 2.
Figure 6:
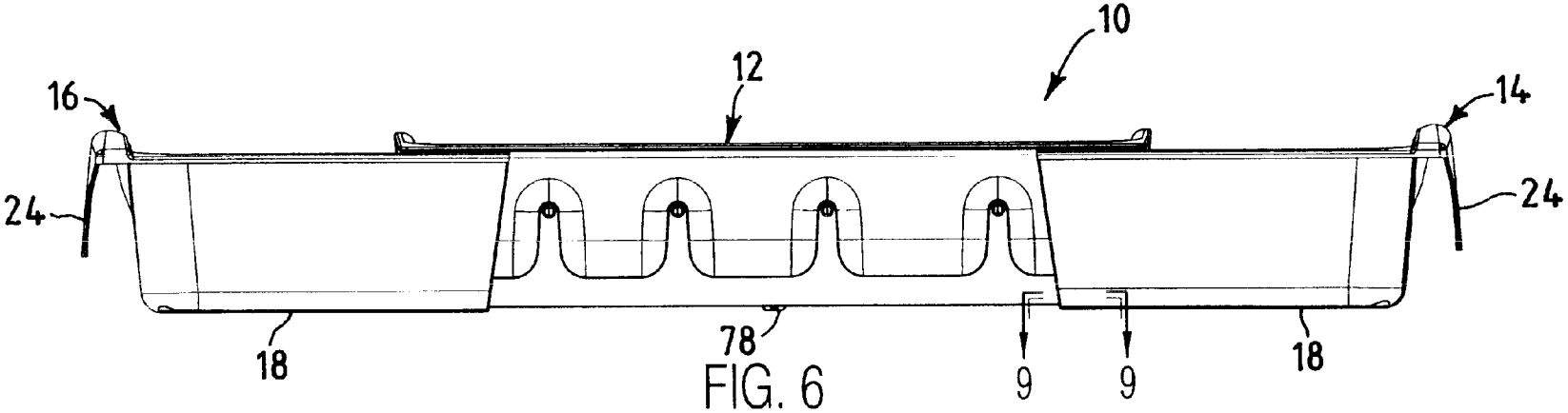
FIG. 6 is front elevation view of the drawer organizer of FIG. 3.
Figure 7:
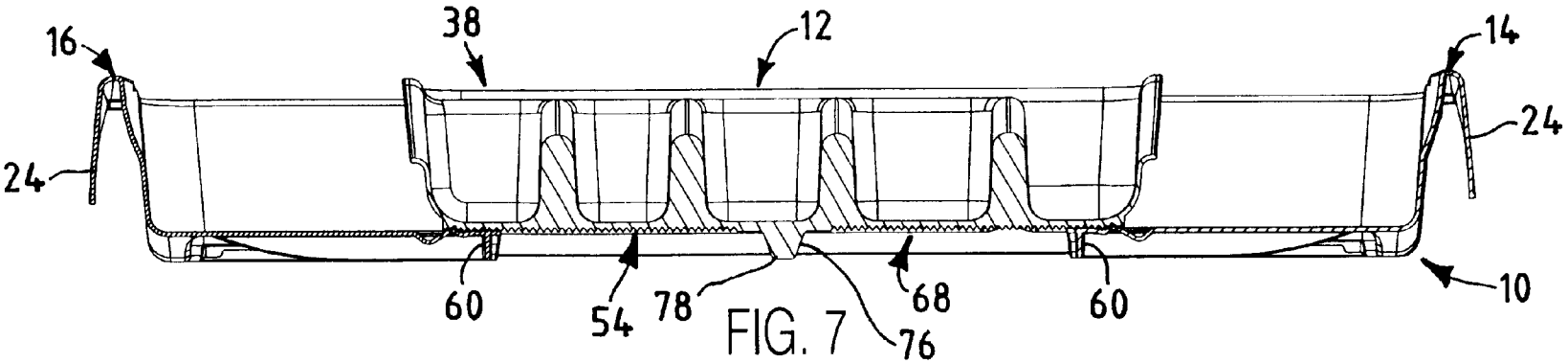
FIG. 7 is a sectional elevation view of the drawer organizer of FIG. 5 taken along line 7—7.
Figure 8:
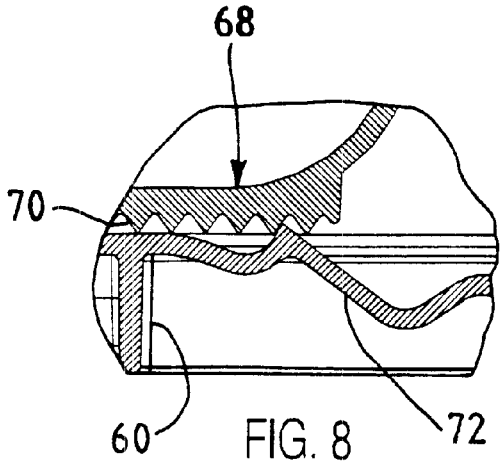
FIG. 8 is a fragmentary sectional view of the drawer organizer of FIG. 7.
Figure 9:
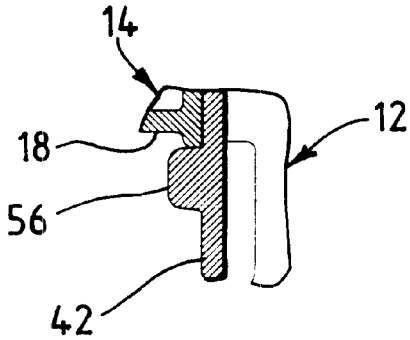
FIG. 9 is a fragmentary sectional view of the drawer organizer of FIG. 6 taken along line 9—9.
Figure 10:
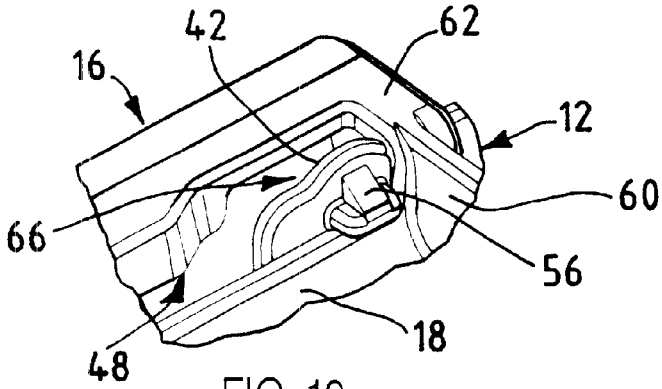
FIG. 10 is a fragmentary perspective view of the drawer organizer of FIG. 3.

As shown in FIGS. 3 and 10, engagement between main compartment 12 and side compartments 14, 16 is along a pair of members (shown as guide ribs 42, 44) of main compartment 12 disposed in a pair of guide slots 46, 48 in side compartments 14, 16. Guide ribs 42, 44 extend along opposite sides of the bottom 54 of main compartment 12 and slide within respective slots 46, 48 in opposite sides of side compartments 14, 16. Each rib 42, 44 includes a projection 56 that extends substantially perpendicular to ribs 42, 44 and is configured to "capture" bottom 18 of side compartments 14, 16 when disposed and projected through slots 46, 48. As such, side compartments 14, 16 slide below main compartment 12 to adjust the width of the assembled organizer 10.

Guide slots 46, 48 of side compartments 14, 16 are proximate the intersection of the bottom 40 and sidewalls 56, 58. A transversely extending flange 60 extends between the sidewalls of each side compartment 14, 16 along bottom surface 40. Bridging portions 62, 64 of flange 60 cover inward ends 66, 67 of the guide slots 46, 48. Guide ribs 42, 44 of main compartment 12 are retained within guide slots 46, 48 of side compartments 14, 16 by bridging portions 62, 64. Flange 60 is also intended to support guide ribs 42, 44 as they reciprocally move within slots 46, 48.

A locking element (shown as a strip 68) extends along the longitudinal center line of bottom surface 54 of main compartment 12. According to a preferred embodiment, strip 68 is integrally formed with main compartment 12 and includes a series of spaced apart, downwardly directed teeth 70 (e.g., it is "serrated"). According to a preferred embodiment, teeth 70 have an incremental pitch of 0.10 inches.

Each side compartment 14, 16 includes a compliant prong 72 formed in the bottom surface 40 configured to engage teeth 70 of rib 68 of main compartment 12 as side compartments 14, 16 move toward and away from main compartment 12. Prong 72 fixes side components 14 or 16 relative to main component 12 when it drops between teeth 70 and sideways pressure stops. Prong 72 is configured to flex or deflect when side compartments 14, 16 are extended or retracted, but to provide a positive lock between the components when the desired position of side compartments 14, 16 relative to main compartment 12 is achieved. According to a preferred embodiment, voids 74 are provided (e.g., molded, machined, etc.) adjacent prong 72 and are intended to improve the flexural characteristics of prong 72.

The sliding engagement between teeth 70 and prong 72 is intended to communicate to the user that incremental width change is occurring. For example, the engagement provides a signal such as an audible click and/or a vibration sensed in the hands of the user. In addition to providing a signal to the user that incremental width change is occurring, teeth 70 are also intended to prevent inadvertent movement of side compartments 14, 16 relative to main compartment 12. This allows the three components 12, 14, 16 to act as one piece when sideways forces do not exist.

When assembled, main compartment 12 is supported by side compartments 14, 16. A center post 76 extends from the underside of bottom 54 of main compartment 12. Under normal conditions, post 76 has a terminal lower end 78 that is spaced above support feet 36 of side compartments 14, 16 and does not contact the drawer surface. Post 76 is configured to provide a support structure for main compartment 12 when side compartments 14, 16 are in the extended position and main compartment 12 is undergoing loading from one or more items being placed in compartments 38.

Although only a few exemplary embodiments of the present invention have been described in detail in this disclosure, those skilled in the art who review this disclosure will readily appreciate that many modifications are possible (such as variations in sizes and proportions of the various elements, materials and the like) without materially departing from the novel teachings and advantages of the invention. For example, the features and combination of features described herein may be used with any of a variety of devices used to organize items on a surface or in an enclosed space. Also, instead of providing a "serrated" strip locking mechanism, other arrangements may be used to provide incremental or variable locking or securing of the compartments. Further, the compliant member may be provided by any number of a variety of configurations or structures which are capable of being biased when the side compartments are pressed against the enclosure. Accordingly, all such modifications are intended to be included within the scope of the invention as defined in the appended claims. Other substitutions, modifications, changes and omissions may be made in the design, operating conditions and arrangement of preferred embodiments without departing from the spirit of the invention as expressed in the appended claims.

What is claimed is:

1. An organizer for a plurality of items, the apparatus comprising:

a main compartment;

at least one side compartment; and a retaining system configured to selectively couple the main compartment to each side compartment, and hold each side compartment in one of a plurality of positions relating to the main compartment, the retaining system includes a strip having teeth and a compliant prong having a tip engageable in the teeth, the strip extends from the main compartment and the prong is disposed on a bottom wall of the side compartment.

2. The organizer of claim 1, wherein engagement of the strip and prong provides a positive lock between the side compartment and the main compartment.

3. The organizer of claim 1, wherein the strip and the prong provide a signal when moved relative to each other.

4. The organizer of claim 1, wherein the retaining system provides a signal when a side compartment is moved relative to the main compartment.

5. The organizer of claim 4, wherein the signal is audible.

6. The organizer of claim 4, wherein the signal is vibratory.

7. The organizer of claim 1, wherein the retaining system includes a rib extending from a bottom of the main compartment and disposed in a slot defined by the at least one side compartment, wherein the rib is configured to be slideably coupled to a bottom of the at least one side compartments.

8. The organizer of claim 1, further including a plurality of feet coupled to a bottom surface of the organizer, the feet providing frictional resistance to movement.

9. An organizer for a plurality of items, the apparatus comprising:

a main compartment;

at least one side compartment; and a retaining system including configured to selectively couple the main compartment to each side compartment, and hold each side compartment in one of a plurality of positions relating to the main compartment, a compliant member configured to deflect when pressed against a wall of an enclosure, wherein the compliant member is a downwardly and outwardly extending flange coupled to a side compartment.

10. The organizer of claim 9, wherein the compliant member is a compressible pad coupled to a side compartment.

11. An organizer for separating a plurality of items, the apparatus comprising:

a main section having one or more compartments;

at least one side compartment; and an engagement mechanism configured to releasably couple the main section and the side compartment, the engagement system including a strip having teeth and a prong engageable in the teeth;

a compliant member adapted to bias the organizer against a wall of an enclosure, wherein the compliant member includes a downwardly extending flange configured to flex toward the organizer when pressed against the wall of the enclosure.

12. An organizer for separating a plurality of items, the organizer comprising:

a main section having one or more compartments;

at least one side compartment; and means for releasably coupling the main section to the first side compartment;

a compliant member adapted to bias the organizer against a wall of an enclosure, wherein the compliant member includes a downwardly extending flange configured to flex toward the organizer when pressed against the wall of the enclosure.

13. The organizer of claim 12, wherein the means for releasably coupling the at least one side compartment to the main section includes a rib coacting with a prong.

14. The organizer of claim 12, further including a means for providing a signal when the means for releasably coupling the main section to the at least one side compartment is engaged.

15. The organizer of claim 14, wherein the means for providing a signal includes a plurality of teeth engaging a prong.

16. The organizer of claim 14, wherein the signal is audible.

17. The organizer of claim 14, wherein the signal is vibratory.

* * * * *